United States Patent [19]

Gladstone et al.

[11] 3,963,458

[45] June 15, 1976

[54] COATED ABRASIVE MATERIAL

[75] Inventors: Matthew T. Gladstone, Scotia; Stanley J. Supkis, Averill Park, both of N.Y.

[73] Assignee: Norton Company, Worcester, Mass.

[22] Filed: Sept. 20, 1973

[21] Appl. No.: 399,106

Related U.S. Application Data

[63] Continuation-in-part of Ser. No. 131,027, April 5, 1971, abandoned.

[52] U.S. Cl. ..... 51/295; 51/298 A; 51/299 R

[51] Int. Cl.[2] ..... C09K 3/14

[58] Field of Search ..... 51/295, 297, 298, 299

[56] References Cited

UNITED STATES PATENTS

| | | | |
|---|---|---|---|
| 2,406,319 | 8/1946 | Brooks et al. | 51/299 |
| 2,650,158 | 8/1953 | Eastman | 51/299 |
| 2,733,987 | 2/1956 | Gartrell et al. | 51/299 |
| 2,822,254 | 2/1958 | Goepfert et al. | 51/298 |
| 2,981,615 | 4/1961 | Baumgartner et al. | 51/298 |
| 3,402,034 | 9/1968 | Schnabel | 51/298 |
| 3,541,739 | 11/1970 | Bryon et al. | 51/295 |
| 3,619,150 | 9/1969 | Rinker et al. | 51/295 |
| 3,806,956 | 4/1974 | Supkis et al. | 51/298 |

*Primary Examiner*—Donald J. Arnold
*Attorney, Agent, or Firm*—Rufus M. Franklin

[57] ABSTRACT

Coated abrasive material is provided having coated on the adhesive bond a supersize layer which improves grinding and which is stabilized against thermal degradation during use of the abrasive material. This layer comprises an elastomeric material and a sufficient amount of antioxidant to limit oxidative degradation and, in the most preferred embodiment, an active solid, particulate filler. The presence of such a layer on articles manufactured from the coated abrasive material results in a much cooler grinding operation thereby reducing the conditions conducive to metal glazing and resulting in extended coated abrasive product life.

16 Claims, 1 Drawing Figure

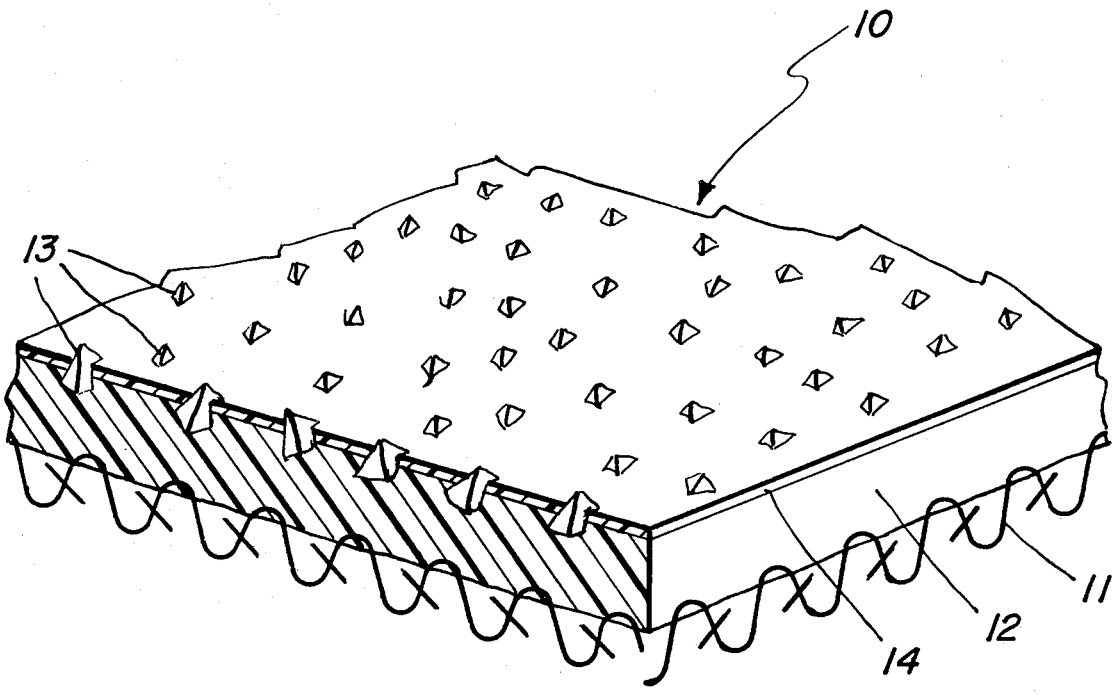
10
13
11
12
14

COATED ABRASIVE MATERIAL

CROSS-REFERENCE TO RELATED APPLICATION

This application is a continuation-in-part of copending application Ser. No. 131,027 filed Apr. 5, 1971 and now abandoned.

BACKGROUND OF THE INVENTION

1. Field of the Invention

This invention relates to new improved coated abrasive material, to its method of manufacture, to articles manufactured therefrom and their usage. More particularly, the invention relates to coated abrasive material having at its exposed grinding surface a coating providing improved abrading characteristics.

2. Description of the Prior Art

Coated abrasive material, which has been manufactured for many years and is commonly referred to as "sandpaper," is in general made by continuously applying to a suitable, relatively wide backing member, a first coat of an adhesive composition, referred to in the art as a "making" coat, followed by the immediate application of abrasive grains. The making coat is solidified to hold the grains on the backing member, after which, in most instances, an adhesive composition referred to as a "sand sizing" coat is applied and solidified. These coats constitute the bond for the abrasive grains and may be of the same or different chemical compositions. After further cure of the adhesive bond, the coated abrasive material thus prepared is then processed into forms more suitable for use such as sheets, rolls, belts and discs.

The use of coated abrasive articles is occasioned, in general, with a relatively high initial rate of cut. However, during use, for various reasons, the rate of cut decreases and when it falls to a rate below economic usefulness the coated abrasive article is discarded. One of the primary reasons for this decrease in cutting rate, where, e.g., metal is being abraded, and attendant with it a change in surface finish, resides in the fact that a freshly exposed metal surface is extremely reactive. Such a fresh or nascent metal surface, e.g., the metal swarf, often forms a weld with the abrasive grain apparently, in some cases at least, by means of a chemical reaction. This phenomena may result, in further usage, in an extremely high shearing force on the abrasive grain which is occasioned with even higher temperatures.

The abrasive grains on a coated abrasive article initially effective in cutting are those extending furthest from the backing member because, as is obvious, these grains first come into contact with the metal being ground. When these abrasive grains form weld junctures, frictional forces exerted thereupon by the workpiece increases, and one by one the abrasive grains are either fractured or upon failure of the grain bond are wrenched free from the backing member. As numerous of these further extending abrasive grains are fractured or removed, the abrading plane is, in general, lowered. Thus, abrasive grains become effective which do not extend outwardly from the backing material as far as the initially effective abrasive grains. As the abrading plane approaches the plane of the backing member, welded abrasive grains become more and more numerous. Ultimately the abrasive surface "glazes over."

One may already have concluded from the above that an interrelationship exists between stock removal temperature and glazing. Factors which tend to raise the local instantaneous temperature at the workpiece-abrasive interface appear to promote welding and glazing. Thus, glazing of a coated abrasive material is self-accelerating in that any increase in temperature at the workpiece-abrasive interface due to friction promotes further abrasive grain-metal welds. These welds, in turn, result in higher frictional forces and temperatures at the workpiece-abrasive interface. Undesirably, the temperature may reach a point at which the metal workpiece becomes "burned" or discolored due to heat.

Glazing, which is of course known to be more of a problem in the abrading of some metals than with others, often occurs when there is yet a substantial portion of the abrasive grains remaining, i.e., not worn down. Consequently, the abrasive article may be rendered commercially useless while the backing member is still in effective condition and before the abrasive grains' usefulness has been expended. When glazing occurs in a grinding operation, a large number of abrasive belts and the like is generally necessary to accomplish a desired surface finish. Thus, in addition to the cost of the abrasive material required to do the job, extra time and effort is consumed during the abrading operation in replacing a useless glazed over abrasive belt with a new one. All of this as is obvious, is accompanied by correspondingly higher manufacturing costs.

Various solutions over the years have been devised to eliminate or at least reduce the glazing problem. In general, these solutions have approached the problem by attempting to reduce friction between the abrasive grains and the metal surface being abraded. The use of waxes, grease sticks, and various liquid lubricants has been suggested, from time to time, for use during the abrading process. These techniques are effective only to a limited degree, and the advantages are frequently offset by the attendant inconvenience, expense, and smudging of the workpiece. Water or oil floods at the point of grinding, in addition to being inconvenient and expensive, are messy. Moreover, water necessitates the use of a waterproof coated abrasive material and oil is a potential fire hazard; the use of either requires special equipment. In any event, although lubricants such as water and oil have been found to retard glazing, for the most part they do not prevent it from ultimately occurring.

Heretofore others have suggested avoiding the problems associated with the use of external "grinding aids" by incorporating a so-called "grinding aid" in the nature of an active filler in a coated abrasive product. Merely by way of example attention is directed to U.S. Pat. No. 3,058,819. Therein is disclosed incorporated in the sand size coat an organic sulfur-containing compound such as, e.g., thiourea. Such a compound in a conventional phenol-formaldehyde binder used in the manufacture of coated abrasives, according to the patentee, inhibits glazing and welding of metal to the abrasive grain.

In recently issued U.S. Pat. No. 3,541,739 there is disclosed an antiweld filler in at least the outermost layer which may be, for example, the supersize layer, which comprises in addition to the filler an adhesive binder. Although other fillers may be included in the composition, the most critical filler is disclosed to be a simple or complex metal halide, the latter being represented by, e.g., sodium fluoaluminate, i.e., cryolite, and potassium fluoborate (potassium borofluoride).

What one might term another species of grinding aid is disclosed in U.S. Pat. No. 3,256,076. The patentee therein discloses applying to the surface of a coated abrasive sheet material, as a supersize layer, a film-forming material which comprises an organic compound containing a chemically bound substituent which decomposes at the grinding temperature and which, in the presence of normal room humidity, is rapidly reactive with or corrosive to the metal being abraded. The chemically bound constituent is chlorine, bromine or divalent sulfur which on decomposition yields HCl, HBr, or $H_2S$. Such a reaction, according to the patentee, is indicated by a reduction in friction between the abrasive granules and the metal surface being abraded. One may conclude, it is believed, that this invention inhibits glazing by lowering the frictional forces in grinding thus lowering the grinding temperature.

One problem heretofore associated with the use of grinding aids incorporated on the surface of the coated abrasive material, especially those in the nature of active fillers, resides in making these grinding aids continually and uniformly available at the metal surface being ground over the life of the abrasive material. Active fillers are, in general, incorporated in a binder therefor and this binder-filler composition is then applied as a layer on the surface of the coated abrasive material. Not all binder materials, however, have been found suitable. Some materials, otherwise satisfactory for binding particulate materials together and to a substrate, either do not adhere satisfactorily to the coated abrasive bond, particularly at the temperatures attained during grinding, or do not have satisfactory cohesive strength at that temperature, or both. This may result in, during usage of the coated abrasive material, flaking off of the grinding aid layer. When this occurs the maximum benefit of the grinding aid is not attained and abrasive product life is improved little, if at all.

An effective binding material for active fillers, and which most unexpectedly was found to improve grinding performance per se, was discovered by Stanley J. Supkis, one of the inventors in this application. This binder is, in general, an elastomeric material which is a copolymer of a conjugated diolefin which when polymerized results in substantial residual unsaturation. These binding materials are described more fully in application Ser No. 141,666, filed May 10, 1971, which is a continuation-in-part of Application Ser. No. 47,786, filed June 19, 1970, now abandoned.

Although these elastomeric binders, e.g., carboxylated butadiene-acrylonitrile have been found most satisfactory for coated abrasive manufacture and performance, the use of coated abrasive material incorporating these binder materials, prior to this invention, has been met, in certain instances, with some objection. This is because the binder materials emit, during usage, particularly with certain applications of the coated abrasive material, noxious odors. These odors are objectionable particularly in manufacturing plants where ventilating systems are either non-existent or inadequate for handling the odor emission.

SUMMARY OF THE INVENTION

Our invention involves, in its basic aspects, the provision at the exposed abrasive surface of a coated abrasive material of a coating or supersize layer comprising an elastomeric material not attendant with the above-mentioned disadvantages and which most advantageously, improves grinding. In the most preferred embodiment of the invention, this coating, which according to this invention is stabilized against oxidative degradation during coated abrasive usage, includes, as well, an active, solid, particulate filler material which functions to further aid grinding performance.

Elastomeric materials which have been found to function in this dual manner, i.e., as a binder material as well as a grinding aid per se, are, in general, polymeric materials of monomers which, when polymerized, result in substantial residual unsaturation.

A grinding aid layer, as is provided by our invention, has been discovered to result in, in certain grinding applications, a noticeable reduction in frictional heat. This, of course, is accompanied with a cooler cutting action which provides less potential for glazing over of the coated abrasive material thereby resulting in extended product life as well as more uniform cut over the life of the abrasive product.

The coated abrasive material of our invention may be used to advantage in various dry grinding applications; however, it will be found particularly useful in light pressure operations, e.g., off-hand sanding, where, in general, there is no big heat build-up. These grinding operations involve, among other things, the dry grinding of brazed welds and workpieces of hard to grind metals such as stainless steels and titanium. The ever increasing use of titanium metal in fabrication of various articles, e.g., in the aircraft industry, has made the need for a solution to safer, better, and faster grinding acute.

An important advantage in lowering the grinding temperature is that lower temperatures present less opportunity for the metallurgical structure of a workpiece to change, sometimes adversely, during grinding. One method conventionally practiced to avoid "burning" of a titanium workpiece during dry grinding is to interrupt the grinding operation periodically to allow the workpiece to cool. Cooling is accomplished in some cases by dunking the workpiece, from time-to-time, in a bucket of water or the like after which the workpiece is wiped with a dry cloth before again commencing the abrading operation. Quite advantageously the improved coated abrasive material of our invention makes such a cooling of the workpiece during grinding of titanium unnecessary.

A further advantage in the use of coated abrasive material according to our invention, particularly in grinding of titanium workpieces, resides in the fact that grinding is accompanied with greatly reduced sparking. This, in and of itself, makes for a much safer grinding operation as grinding of titanium workpieces is generally accompanied with a voluminous production of sparks.

BRIEF DESCRIPTION OF THE DRAWING

The invention is described hereinafter in greater detail by reference to the drawing which consists of a sole FIGURE showing, greatly enlarged, a perspective view of a portion of a coated abrasive material according to the invention.

It should be understood, however, that the drawing and examples hereinafter given are shown for purposes of illustration only and that the invention in its broader aspect is not limited thereto.

DETAILED DESCRIPTION OF THE INVENTION

Referring now to the drawing, there is disclosed coated abrasive material 10 comprising a backing member 11, a bond 12, and abrasive grain 13. On top of bond 12 is a supersize layer or coat 14 with which our invention is particularly concerned.

Backing member 11 can be of, e.g., paper, cloth or a laminate of paper plies, cloth plies, or a combination of paper and cloth plies vulcanized fiber, or other flexible strong material, all of which are used customarily in the manufacture of coated abrasive material. As is conventional in the art, the backing member can be filled, if cloth, or impregnated, if paper, with various desired materials, these materials being well-known in the abrasive industry. Moreover, it can be further provided with front and backsize materials, barrier costs, and the like, as desired.

Bond 12, which secures abrasive grain 13 to the backing member can be solely a maker coat or it can include a size coat, as is conventional, as well. Where a size coat is provided, the maker adhesive may be any of the materials used conventionally in the manufacture of coated abrasives, e.g., glue, resinous materials such as the phenolics, alkyds, epoxies, urea-formaldehyde, and the like. The size coat can be of the same formulation as the maker adhesive of different, however, where a glue maker adhesive composition is used, the size coat must be of a heat hardenable resinous composition. The manner of application of the material for the adhesive bond will, of course, depend somewhat on the particular material chosen; however, the means for and manner of application of these bonding materials are well known in the abrasive art. As is believed obvious, the material used for the bond will depend on the particular properties desired in the ultimate coated abrasive product. Merely by way of example, we have found that particularly good results are obtained in the practice of our invention, where both the maker and size coats are of phenol-formaldehyde resin compositions.

Abrasive grains with which one will obtain improved results in the practice of this invention include silicon carbide, alumina, and polycrystalline abrasive grain of, e.g., fused zirconia-alumina, all of which are conventionally used in the manufacture of coated abrasive material. The size grain used depends, of course, somewhat on the particular grinding application. Particularly good results will be obtained with medium and coarse grit abrasive grain. In general, however, in polishing operations where 150 grit and finer is used, there is insufficient heat buildup to cause decomposition of the active filler, if such a grinding aid is used in combination with the elastomeric material.

Supersize layer 14 comprises an elastomeric material which actively aids in increasing the cutting ability of coated abrasive products. Importantly, and of critical concern in the practice of this invention, the supersize layer contains a sufficient amount of antioxidant so that the elastomeric material is stabilized against oxidative degradation at the temperatures achieved during grinding. The elastomeric material is, moreover, characterized by its good adhesion to a conventional coated abrasive bond, in particular phenol-formaldehyde resin, and its physical properties which permit it to desirably soften during grinding without blistering. These properties are desirable in that they prevent undesirable flake-off of the supersize layer during usage of the abrasive material and provide that it (the supersize layer) will be available to perform its intended function during the life of the coated abrasive material. The elastomeric material used in the practice of this invention functions not only as a grinding aid, in and of itself, but also as a binder by means of which particulate grinding aid material, as hereinafter further described, may also be incorporated in the supersize layer.

Materials which will perform this dual function, i.e., function as a grinding aid as well as a binder for particulate grinding aids, are polymeric materials or conjugated diene monomers, e.g., butadiene and its homologues, which when polymerized result in substantial residual unsaturation. By this is meant a degree of unsaturation that would be indicated by an iodine number of at least about 105. The invention, however, is not limited solely to homopolymers of these materials and, in its preferred aspects, include copolymers thereof with, for example, monomers copolymerizable therewith such as acrylonitrile and styrene. Other polymeric materials of this class and which are most desirably used in the practice of this invention are carboxylated butadiene-acrylonitrile and carboxylated butadiene-styrene copolymers. Where, however, a copolymer is utilized in the practice of the invention, the copolymer must contain no less than about 50% by weight (total) of the conjugated diolefin. Such a copolymer containing butadiene-styrene may have an iodine number of about 160.

Polymeric materials, as above disclosed, which meet the requirements of this invention are readily available commerically. Carboxylated copolymers found suitable as a grinding aid per se and as a binder for particulate grinding aids are available, e.g., from Standard Brands Chemical Industries, Inc. (formerly International Latex Corporation) in the form of a nonionically stabilized latex (40% by weight solids) under the trade designation TYLAC. These latices and their manner of manufacture are believed disclosed in U.S. Pat. Nos. 2,961,348; 3,256,234; and 3,422,050, the disclosures of which are herein incorporated by reference. As disclosed in these patents, carboxylation occurs through introduction of an ethylenically unsaturated monocarboxylic acid, e.g., acrylic and methacrylic acid, or a partial ester of unsaturated polybasic acids, e.g., itaconic, fumaric, and maleic acid into the polymeric chain.

One carboxylated copolymer found particularly suitable in the practice of the invention is identified by the trade designation TYLAC 3502A and is believed to comprise (by weight dry monomer solids) about 17% acrylonitrile and from about 1–3% carboxylic acid, the remainder being substantially butadiene. Another suitable copolymer is available under the trade designation TYLAC 4485C and is believed to comprise, on a monomer total weight basis, about 56% butadiene, about 41% styrene, and about 3% carboxylic acid.

These polymeric materials and latices thereof are deemed well known in the coating art and require no further detailed explanation herein. As is usual, these latices, in addition to their major components, also include antioxidants, and wetting and stabilizing agents. The latter agent is necessary to prevent the latex solids from salting out on adding the active particulate filler as hereinafter described. Those stabilizing agents which will provide an optimum coating composition are deemed sufficiently well known in the coating art to require no further explanation herein. However, it should be pointed out that, in general, a larger amount of such an agent is required in latices used in the practice of this invention than is used in ordinary coating applications. Satisfactory results will be obtained where the amount of stabilizing agent is from about 3–12% by weight (dry) of the latex solids.

The polymeric material used should be substantially free of any butadiene monomer. Most importantly, the composition must be stabilized with a sufficient amount of antioxidant to preclude oxidation of the polymeric material during coated abrasive usage. Without a sufficient amount of antioxidant, a noxious odor will be given off during usage of the coated abrasive material. This odor, we believe, results from free radical formation on oxidation of the polymer which in turn results in depolymerization to butadiene. The amount of antioxidant required in any particular supersize composition will, of course, depend on the grinding application as well as the specific antioxidant used. In some grinding applications, e.g., mechanical automatic grinding, where high pressures are encountered, attendant with extremely high temperatures, the invention is used to less advantage. However, in light pressure grinding applications, the invention will be found particularly advantageous in that much improved cutting results are obtained without emission of a noxious odor. In these last-mentioned applications, good results are obtained where the antioxidant is at least about 4% by weight of the polymeric material. Below this amount, an insufficient amount of antioxidant is provided to retard oxidation of the polymeric material during the life of the coated abrasive product being used and a noxious odor is given off.

The invention is not limited to the use of any particular antioxidant. Any of those conventionally used for this purpose may be used; however, the minimum amount thereof in the supersize layer to achieve the desired results is deemed critical, as above-mentioned. Those antioxidants which will be found particularly suitable in the practice of the invention include napthylamines, alkylated phenols, polyalkyl polyphenols, and hydroquinones. Mixtures of antioxidants can also be mixed, is desired.

As before-mentioned, in the preferred embodiment of the invention, there is included in the supersize layer or coat an active particulate filler which further aids grinding performance. Various fillers of this nature are known to those in the coated abrasive industry. Those fillers which may be satisfactorily used in our invention are the metal fluorides, in particular, the complex alkali metal fluorides. Suitable such halides include, e.g., sodium aluminum hexafluoride, potassium aluminum hexafluoride, sodium silicofluoride, sodium fluoborate, potassium silicofluoride, and potassium fluoborate. Other known active fillers, however, may be used in place of those above-mentioned, and in some instances to good advantage in combination therewith. These other fillers include, but are not limited to active fillers such as simple metal halides, e.g., calcium fluoride, aluminum fluoride, sodium fluoride, and potassium fluoride.

Where an active filler is desired to be included in the supersize layer, the weight thereof should not be greater than about 60% by weight (dry basis) of the total coating composition. Lesser amounts of elastomeric binder in the supersize layer presents problems in coating such a supersize composition and, most disadvantageously, results in inadequate adhesion between the particles of active filler and of the layer coated to the coated abrasive bond. The preferred weight is from about 30–50% by weight, the higher weight being even more preferred, of active filler based upon the total weight (dry basis) of grinding aid and elastomeric material.

In the practice of this invention, the manner of application of layer 14 may depend somewhat on the particular polymeric material chosen. However, any of the usual means for application, e.g., roll coating, spray coating, air knife, etc., will be found satisfactory. Where the layer is to be deposited from a latex composition as above-described, which in the preferred formulation also includes an active filler, the latex composition for application to coated abrasive material will preferably comprise about 50 percent or more total solids. Such a composition may be prepared by adding to the commercially available 40% latex composition before-mentioned a weight of filler equal to the latex solids. When such a latex composition is roll coated, according to usual techniques and doctored with, e.g., an air knife, a uniform appearing supersize layer will result. With a lesser solids content application by roll coating is possible, however, one obtains on drying a layer having a mottled or non-uniform appearance. Even so, however, when the same amounts of composition are applied the results in grinding are comparable. The active filler most preferred is a complex sodium fluoride, this being soluble in the aqueous vehicle for the polymeric binder whereby, on application and subsequent drying, the active filler will be well dispersed throughout layer 14.

The amount of latex composition applied to the coated abrasive material, as is deemed obvious, will of course depend on a number of factors, e.g., size of abrasive grain, spacing of the grain, solids content, etc. The main consideration to keep in mind is that, in general, it is desirable to apply a sufficient quantity of latex composition so that on drying and during use of the coated abrasive material the supersize layer will be as closely adjacent the surface of the metal being ground as possible. Such a feature may not be particularly evident from the drawing since for sake of clarity and to emphasize preference for the tips of the abrasive grain remaining uncoated, a larger portion of abrasive grain is exposed than is desirable. However, it is in general undesirable, that the abrasive grains be entirely covered over. This generally leads to merely smearing the layer 14 on the surface to be ground thus resulting in relatively little, if any, cut. The tips of the abrasive grain in the resulting coated abrasive product must at least be exposed and if not must be exposed on application of pressure at the start of the grinding operation. Where layer 14 covers over the abrasive grain tips, these products are unsuitable in off-hand grinding operations; however, where higher pressures are encountered, e.g., mechanical automatic grinding, the fact that the abrasive grain tips are covered over initially is of less consequence. Generally speaking, however, in coarser grade abrasive products, a greater amount of supersize is deposited on the surface thereof than with finer grades. However, the optimum amount of latex composition applied as well as the exact solids formulation thereof for any particular grinding application is best determined by a few simple experiments in the laboratory.

Subsequent to application to the coated abrasive material, the latex composition is dried to remove the water therefrom and to bring about fusion of the particulated carboxylated copolymer. The drying time required, depends, of course, on factors such as temperature, amount of water present in the latex composition, and the like. However, merely by way of example, satisfactory drying can be accomplished, in general, by heating with air at 100° F. for about 30 minutes. Afterwards, the dried deposit is fused by heating at 225° F. for at least about 10 minutes. Obviously, drying and fusion can be accomplished at room temperature, however, this takes much longer.

The thus manufactured coated abrasive material is then further processed in accordance with usual techniques into forms more suitable for use in grinding operations such as sheets, rolls, belts and discs.

The following specific examples will illustrate more clearly the preferred embodiments of the invention.

EXAMPLE 1

A coated abrasive belt was prepared according to usual techniques utilizing a conventional 50× RESINALL METALITE abrasive cloth. This belt was then used as a control and its cutting performance was evaluated in a standard bench backstand belt test. In this test, the abrasive belt, positioned horizontally, is moved inwardly at a constant pressure (15 lb. dead weight) and in a direction substantially normal against the ½ inch face of a workpiece (½ × 2 × 9 ¾ — 304 stainless steel) moving back and forth over a distance of 9 ¾ inches at 7 feet per minute. A 55 durometer, rubber, vertically disposed, serrated contact wheel (7 inches diameter) was used for the belt which was operated at a belt speed of 5500 surface feet per minute (SFPM). The workpiece was removed after ten minutes and the amount of cut (118 grams) was determined.

EXAMPLE 2

An abrasive belt was manufactured as in Example 1 except that the abrasive material, prior to belt formation, was provided with a dried, fused, elastomeric coating of a carboxylated butadiene-acrylonitrile.

The carboxylated butadiene-acrylonitrile coating was provided by coating on the abrasive material a sufficient quantity of a 40% latex composition, available commercially under the trade designation TYLAC 3502A, to provide a dried weight of about 6.0 lbs. per sandpaper maker's ream (480 sheets — 9 × 11 inches). After application the wet latex composition was dried and fused by heating the abrasive material in an oven at 225° F. for ½ hour.

The belt was evaluated as before described in Example 1. The results in cut were 117 percent better than in Example 1; however, during evaluation of this belt a noticeable odor was given off, after about 5 secs. use, making usage thereof objectionable without more adequate ventilation.

EXAMPLES 3–7

Abrasive belts were prepared and evaluated as described in Examples 1 and 2; however, in these belts the supersize layer composition was modified by incorporating therein various amounts of 4,4′ thiobis (6 tertbutyl m-cresol), an antioxidant available under the trade designation Santo White (crystals) from Monsanto Company. The results are given below with Example 1 results in cut being used as a control.

| EXAMPLE | % ANTIOXIDANT BY WEIGHT TOTAL LATEX SOLIDS* | % CUT OF CONTROL |
|---|---|---|
| 3 | 2 | 124 |
| 4 | 4 | 118 |
| 5 | 6 | 119 |
| 6 | 8 | 125 |
| 7 | 10 | 123 |

*The antioxidant, a solid, was formulated with water to make a paste (50% solids). The paste was then added to the latex composition in sufficient amount to provide in the latex composition the indicated total percentage of antioxidant. The latex, as received, contains about 1% antioxidant.

As indicated by the data, compared to Example 1, cutting efficiency is improved considerably by the presence of a supersize layer having residual unsaturation therein. Odor was objectionably noted with less than 6 percent total antioxidant. In Examples 6 and 7, a slight odor persisted for about ½ minute after beginning the grinding test. This odor is believed due to butadiene monomer present and remaining after the polymerization to the latex composition. Thus, this potential odor emitting source is quickly eliminated by evaporation at the beginning of the grinding operation. Its presence can be avoided altogether by ensuring the latex used is free from this undesirable monomer. This can be accomplished, for example, by conventionally stripping the monomer from the latex after its manufacture.

EXAMPLE 8

A coated abrasive belt was manufactured and evaluated on stainless steel as described in the preceding examples except that the elastomeric supersize composition was a carboxylated butadiene-styrene copolymer stabilized against oxidation (4% by weight antioxidant — based on total weight of solids in the latex composition) at the temperatures achieved during usage of the abrasive belt. The latex used in this example is available commercially under the trade designation TYLAC 4485C.

On evaluation and comparison with Example 1, this supersize layer was found to greatly improve cutting (126 percent based on Example 1 cut). No noxious odor was emitted during belt usage.

EXAMPLES 9–19

Various other commercially available antioxidants were evaluated, as below indicated, and found comparable in inhibiting odor emission from the supersize layer of the elastomeric material of Example 2. The coated abrasive belts in these examples were evaluated in like manner as before-disclosed except that grinding was performed for only two minutes after which the amount cut was determined. The results are given below.

| EXAMPLE NO. | ANTIOXIDANT (10% BY WT. TOTAL LATEX SOLIDS) | CUT IN GRAMS |
|---|---|---|
| 9 | 2,6-di-tert- -dimethylamine p-cresol | 35 |
| 10 | 4,4′-thiobis (6 tert-butyl-o-cresol) | 31 |
| 11 | 2,6-di-tert-butyl- -methoxy-p-cresol | 34 |
| 12 | 4,4′-bis (2,6-di-tert-butyl phenol) | 29 |
| 13 | 4,4′-methylene bis (2,6 di-tert-butyl phenol | 31 |
| 14 | phenyl- -naphthylamine | 42 |
| 15 | N-phenyl- -napthylamine | 31 |
| 16 | 2,6-di-tert-butyl-4-methyl phenol | 34 |
| 17 | 4,4-butylidene bis (6 tert-butyl m- | 33 |

-continued

| EX-AMPLE NO. | ANTIOXIDANT (10% BY WT. TOTAL LATEX SOLIDS) | CUT IN GRAMS |
|---|---|---|
| | cresol) | |
| 18 | sym di-beta napthyl-p-phenylene diamine | 33 |
| 19 | hydroquinone monobenzyl ether | 28 |

Cutting efficiency is seen to be comparable in each of the above examples. None of the abrasive belts tested emitted a noxious odor after the residual butadiene monomer was expelled. This is accomplished, in general, in about 5 seconds after grinding begins.

EXAMPLE 20

A 50 percent total solids content supersize composition was prepared by adding to TYLAC 3502A latex composition a suitable amount of sodium fluoborate to provide a 1:1 ratio (by weight) sodium fluoborate to latex solids and 1:10 ratio (by weight) Santo White Crystals to latex solids. The latter component is an antioxidant (4,4'-thiobis (6 tert-butyl m-cresol) available from Monsanto Company. The thus prepared composition (at room temperature, e.g., 75° F.) was then applied to the abrasive surface of a conventional 60× RESINALL METALITE abrasive cloth. A sufficient amount of the composition was applied to the coated abrasive material to provide, on subsequent drying and curing, a weight of about 12.0 lbs. per sandpaper maker's ream.

The wet coating was air dried for 30 minutes at 100° F. after which it was heated for 10 minutes at 225° F. to fuse the latex solids together. With fusion, the carboxylated butadieneacrylonitrile copolymeric composition results in a layer of elastomeric material. On examination of the coated abrasive material, the tips of the abrasive grains were exposed sufficiently to be noticeable when running one's fingers over the abrasive surface.

On evaluation of abrasive belts of this material, as in Example 1, the cut in ten minutes was determined to be 231 grams. In contrast, a like abrasive belt but without a supersize layer thereon cut only 112 grams over the same period of time. As before indicated, with this level of antioxidant no noxious odor is emitted during usage of the abrasive material.

EXAMPLE 21

A supersize composition was prepared as in Example 20 except that the weight percent of sodium fluoborate was only 30 percent of the total latex solids. A sufficient amount of this latex composition was coated on abrasive material as in the preceding example to provide a dried elastomeric layer weighing 7.8 lbs. per sandpaper maker's ream. When an abrasive belt of this material was evaluated, no noxious odor was noticed, and the amount cut was found greatly improved (172 grams) over the control (112 grams).

EXAMPLE 22

A supersize composition was prepared (50 percent solids) by adding to TYLAC 4485C latex composition a suitable amount of sodium fluoborate to provide, by weight latex solids, 30 percent active particulate filler. The amount of antioxidant in the latex composition was 4% by weight solids. The dried, fused, elastomeric layer weighed 7.8 lbs. per sandpaper maker's ream.

On evaluation, as before-described, the amount cut was 231 grams. When compared with the control (112 grams cut) one readily appreciates the improvement brought about with using a grinding aid layer as disclosed herein.

EXAMPLES 23–29

In these examples, various coated abrasive materials were evaluated, as before-described in Example 1, on 304 stainless steel. The abrasive products evaluated differed in the adhesive bond of the coated abrasive material and in the composition of the supersize layer where such a layer was provided. The antioxidant used was an alkylated mixed phenol and was at the 4 percent level in all instances.

| EXAMPLE | ABRASIVE MATERIAL TYPE | TIME IN MINUTES | CUT IN GRAMS |
|---|---|---|---|
| 23 | 50X RESINALL METALITE Cloth | 10 | 152 |
| 24 | 50X RESINALL METALITE Cloth (Super size coat TYLAC 4485C only) | 10 | 173 |
| 25 | 50X RESINALL METALITE Cloth (TYLAC 4485C + active filler**) | 10 | 221 |
| 26 | 50X RESINIZED METALITE Abrasive Cloth*** | 10 | 163 |
| 27 | 50X RESINIZED METALITE abrasive cloth (TYLAC 4485C + active filler**) | 10 | 221 |
| 28 | 50X METALITE ABRASIVE CLOTH**** | 10 | 113 |
| 29 | 50X METALITE cloth (TYLAC 4485C + active filler**) | 10 | 115 |

*This abrasive material has a phenol-formaldehyde resin maker and size coat. The abrasive grain is aluminum oxide, grit size 50.

**The supersize composition was like that in Example 20 except carboxylated butadiene-styrene latex was used.

***The abrasive material has a glue maker adhesive and a heat hardened phenol-formaldehyde resin size adhesive.

****Adhesive bond in this abrasive material is glue.

The above examples indicate, it is believed, the significance of having an adhesive bond, the size coat of which at least is of a resinous composition. The results in Examples 28 and 29 show no improvement in cut where a supersize composition in accordance with the invention is applied to coated abrasive material having a glue maker-size adhesive.

EXAMPLE 30

Abrasive material as disclosed in Examples 26, 27 was evaluated on zinc die cast workpieces rather than stainless steel. The results are given below.

| ABRASIVE MATERIAL TYPE | TIME IN MINUTES | CUT IN GRAMS |
|---|---|---|
| Example 26 | 20.0 | 380 |
| Example 27 | 20.0 | 231 |

This test is like that disclosed in Example 1 except a medium soft contact wheel and a dead weight of 10 lbs. was used at a belt speed of 5000 SFPM.

The test indicates the adverse effect resulting from providing a supersize layer according to the invention on coated abrasive material for certain applications.

EXAMPLE 31

Abrasive material was evaluated on stainless steel as before disclosed except that the abrasive grain (grit 50) was of an alumina-zirconia eutectic composition rather than aluminum oxide. The control was of the same abrasive material except that it had no grinding aid layer. The grinding aid layer was the same carboxylated butadiene-styrene composition as disclosed in Example 25.

| ABRASIVE MATERIAL | TIME (MINUTES) | CUT (GRAMS) |
|---|---|---|
| CONTROL | 10 | 187 |
| ALUMINA-ZIRCONIA | 10 | 272 |

Testing, conducted as disclosed in Example 1, indicated the important contribution in grinding performance on stainless steel achieved through using coated abrasive material using in combination alumina-zirconia abrasive grain and a grinding aid as disclosed herein.

EXAMPLE 32

Conventional abrasive material (E weight paper — aluminum oxide abrasive grain — 100 grit) was coated with a supersize layer as disclosed in Example 25. This material was then evaluated on wood according to usual techniques against a control of the same abrasive material except that it was not provided with a supersize layer.

The abrasive material containing the supersize layer not only cut less well but the supersize layer seemed to lead to earlier loading.

EXAMPLE 33

Abrasive material 60× RESINALL DURITE abrasive cloth used conventionally in the grinding of titanium metal (6A14V) was provided with a supersize layer as disclosed in Example 25. This abrasive material was evaluated against a control of the same silicon carbide abrasive material except the control was not provided with a supersize layer. Over a ten minute period, the control cut 12.5 grams. By comparison the abrasive material having the supersize layer cut 24.5 grams. At the end of the ten minute period, moreover, the control belt was cutting at a rate of only 0.5 grams per minute while the belt with the supersize layer was cutting at 4 grams per minute.

EXAMPLE 34

Abrasive material as in Example 33 was evaluated on titanium metal except the abrasive grain was grit 80. In this test, the dead weight load was reduced to 10 lbs. The control belt over a ten minute period cut a total of 14 grams, compared to 21.5 grams for the belt with the supersize. The rate of cut at the end of the ten minute period was 2 grams per minute for the control belt, 3.5 per minute for the experimental belt having the supersize layer.

As many different embodiments of this invention will occur to those skilled in the coated abrasive art, it is to be understood that the specific embodiments of the invention as presented herein are intended by way of illustration only and are not limiting upon the invention, but that the limitations thereon are to be determined only from the appended claims.

What we claim is:

1. In coated abrasive material comprising a flexible backing member, an adhesive bond on the front surface of said backing member, and abrasive grains firmly affixed by the adhesive bond to the backing member, a multiplicity of said abrasive grains extending outwardly from the adhesive bond, the improvement comprising a supersize coating over the adhesive bond which adhesive bond comprises a maker adhesive and a size adhesive, the size adhesive at least comprising a first heat hardened resinous composition, and said supersize coating over said heat hardened coating comprising a dried, fused, elastomeric material selected from the group consisting of polymers of a monomer which when polymerized results in substantial residual unsaturation and copolymers of such aforementioned monomer with at least one monomer copolymerizable therewith, said elastomeric material being active in increasing the cutting ability of the coated abrasive material, and said coating including a sufficient amount of antioxidant therein, at least 4% by weight, said antioxidant selected from the group consisting of napthylamines, alkylated phenols, polyalkyl polyphenols, hydroquinones, and mixtures thereof whereby said elastomeric material is stabilized against decomposition by heat generated while the coated abrasive material is being used, said supersize coat including a solid particulate metal fluoride grinding aid in an amount not more than 60% of the total supersize coating weight.

2. In coated abrasive material according to claim 1, said antioxidant being 4,4′-thiobis (6 tert-butyl m-cresol).

3. In coated abrasive material according to claim 1, said first mentioned monomer being selected from the group consisting of conjugated diolefins and homologues thereof.

4. In coated abrasive material according to claim 3, said conjugated diolefin being butadiene.

5. In coated abrasive material according to claim 4, said elastomeric material being essentially free of monomeric butadiene.

6. In coated abrasive material according to claim 1, wherein said elastomeric material is a copolymer, said first-mentioned monomer therein being no less than about 50% by weight of the total weight of the copolymer.

7. In coated abrasive material according to claim 6, said first-mentioned monomer being butadiene and said copolymerizable monomer being acrylonitrile.

8. In coated abrasive material according to claim 6, said first-mentioned monomer being butadiene and said copolymerizable monomer being styrene.

9. In coated abrasive material according to claim 6, wherein said copolymer comprises in addition to monomers of butadiene and acrylonitrile a monomeric member of the group consisting of ethylenically unsaturated monocarboxylic acids and partial esters of unsaturated polybasic acids.

10. In coated abrasive material according to claim 6, wherein said copolymer comprises in addition to monomers of butadiene and styrene a monomeric member of the group consisting of ethylenically unsaturated monocarboxylic acids and partial esters of unsaturated polybasic acids.

11. In coated abrasive material according to claim 1, said complex alkali metal fluoride being sodium borofluoride.

12. In coated abrasive material according to claim 1, said abrasive grain being selected from the class of medium and coarse grit grains.

13. In coated abrasive material according to claim 12, said abrasive grain being no finer than 150 grit.

14. In coated abrasive material according to claim 1, at least some of said abrasive grains being exposed at their outer tips.

15. In coated abrasive material according to claim 1, said heat-hardened resin comprising phenol-formaldehyde.

16. In coated abrasive material according to claim 15, said maker adhesive comprising phenol-formaldehyde.

* * * * *